US006468370B1

(12) United States Patent
Blomquist

(10) Patent No.: US 6,468,370 B1
(45) Date of Patent: Oct. 22, 2002

(54) GAS GENERATING COMPOSITION FOR VEHICLE OCCUPANT PROTECTION APPARATUS

(75) Inventor: Harold R. Blomquist, Gilbert, AZ (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/552,122

(22) Filed: Apr. 19, 2000

(51) Int. Cl.[7] ..... C06B 25/00; C06B 25/02
(52) U.S. Cl. ..... 149/88; 149/108; 280/741
(58) Field of Search ..... 149/88, 108, 19.1, 149/19.5; 280/741

(56) References Cited

U.S. PATENT DOCUMENTS 4,298,412 A * 11/1981 Biddle et al. ..... 149/19.5
4,407,119 A * 10/1983 Biddle et al. ..... 60/219
4,997,499 A * 3/1991 Adolph ..... 149/88
5,114,506 A 5/1992 Consaga et al.
5,507,891 A * 4/1996 Zeigler ..... 149/47
5,652,409 A * 7/1997 Thompson et al. ..... 149/98
6,110,306 A * 8/2000 Consaga ..... 149/108
6,177,033 B1 * 1/2001 Nauflett et al. ..... 264/3.1
6,293,201 B1 * 9/2001 Consaga ..... 102/263

* cited by examiner

*Primary Examiner*—Michael J. Carone
*Assistant Examiner*—Aileen J. Baker
(74) *Attorney, Agent, or Firm*—Tarolli, Sundheim, Covell, Tummino & Szabo L.L.P.

(57) ABSTRACT

An apparatus (10) comprises a vehicle occupant protection device (14), and an actuator (10) for the vehicle occupant protection device (14). The actuator (10) includes a gas generating material (18) or both a gas generating material (18) and an autoignition material (66). The gas generating material (18), the autoignition material (66), or both the gas generating material (18) and the autoignition material (66) comprise a plasticized cyclodextrin nitrate ester. The plasticized cyclodextrin nitrate ester has an autoignition temperature in the range of about 150° C. to about 180° C. and is resistant to thermal decomposition at a temperature less than 150° C.

37 Claims, 1 Drawing Sheet

GAS GENERATING COMPOSITION FOR VEHICLE OCCUPANT PROTECTION APPARATUS

FIELD OF THE INVENTION

The present invention relates to an apparatus for inflating an inflatable vehicle occupant protection device and, more particularly, to a gas generating composition for a vehicle occupant protection apparatus.

BACKGROUND OF THE INVENTION

An inflatable vehicle occupant protection device, such as an air bag, is deployed upon the occurrence of a vehicle crash. The air bag is part of a vehicle occupant protection apparatus, which further includes a crash sensor and an inflator. The inflator includes a housing, a gas generating material in the housing, and an igniter. The igniter is actuated so as to ignite the gas generating material when the vehicle experiences a collision for which inflation of the air bag is desired to protect the vehicle occupant. As the body of gas generating material burns, it generates a volume of inflation gas. The inflation gas is directed into the air bag to inflate the air bag. When the air bag is inflated, it expands into the vehicle occupant compartment and helps to protect the vehicle occupant.

Inflator housings may be formed from lightweight materials, such as aluminum. These lightweight materials can lose strength at abnormally high temperatures, such as those reached in a vehicle fire. At temperatures experienced in a vehicle fire, the gas generating material may autoignite and produce inflation fluid at a pressure sufficient to cause the inflator housing to lose its structural integrity due to the reduced strength of the inflator housing material. To prevent such loss of structural integrity, inflators typically include an autoignition material that will autoignite and initiate combustion of the gas generating material at a temperature below that at which the material of the housing begins to lose a significant percentage of its strength.

SUMMARY OF THE INVENTION

The present invention is an apparatus that comprises a vehicle occupant protection device and an actuator for the vehicle occupant protection device. The actuator includes a gas generating material or both a gas generating material and an autoignition material. Either the gas generating material or the autoignition material, or both the gas generating material and the autoignition material comprise a plasticized cyclodextrin nitrate ester. The plasticized cyclodextrin nitrate ester has an autoignition temperature in the range of about 150° C. to about 180° C. and is resistant to thermal decomposition at a temperature less than 150° C.

BRIEF DESCRIPTION OF THE DRAWINGS

Further features of the present invention will become apparent to those skilled in the art to which the present invention relates from reading the following description with reference to the accompanying drawings, in which.

DESCRIPTION OF A PREFERRED EMBODIMENT

Figure 1:
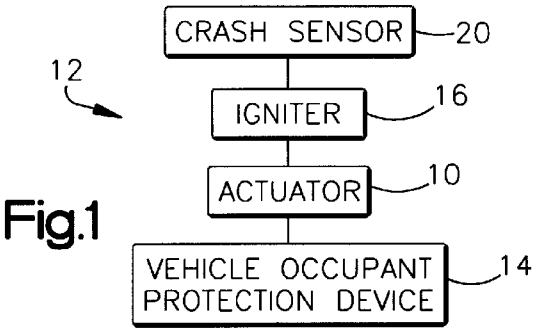
FIG. 1 is a schematic view of a vehicle occupant protection apparatus including an inflator constructed in accordance with the present invention.

As representative of the present invention, FIG. 1 illustrates schematically a vehicle occupant protection apparatus

12. The apparatus 12 includes a vehicle occupant protection device 14. In one embodiment of the invention, the vehicle occupant protection device 14 is an air bag. Other vehicle occupant protection devices that can be used in accordance with the present invention are, for example, inflatable seat belts, inflatable knee bolsters, inflatable head liners, inflatable side curtains, knee bolsters operated by inflatable air bags, and seat belts actuated by seat belt pretensioners.

The apparatus 12 comprises an igniter 16. The igniter 16 is electrically actuatable to ignite a gas generating material 18 (FIG. 2) contained within an actuator 10. Combustion of the gas generating material 18 produces a combustion gas that actuates the vehicle occupant protection device 14. When the vehicle occupant protection device 14 is actuated, it helps to protect a vehicle occupant from a forceful impact with parts of the vehicle as a result of a crash.

The apparatus 12 also includes a crash sensor 20. The crash sensor 20 is a known device that senses a vehicle condition, such as sudden vehicle deceleration, indicative of a collision or rollover. The crash sensor 20 measures the magnitude and duration of the deceleration. If the magnitude and duration of the deceleration meet or exceed predetermined threshold levels, the crash sensor 20 transmits a signal or causes a signal to be transmitted to actuate the actuator 10.

In the one embodiment of the present invention, the actuator 10 is a pyrotechnic inflator for producing gas to inflate an air bag. The actuator, however, could be a gas generator for a seat belt pretensioner (not shown), or a hybrid air bag inflator (not shown).

Figure 2:
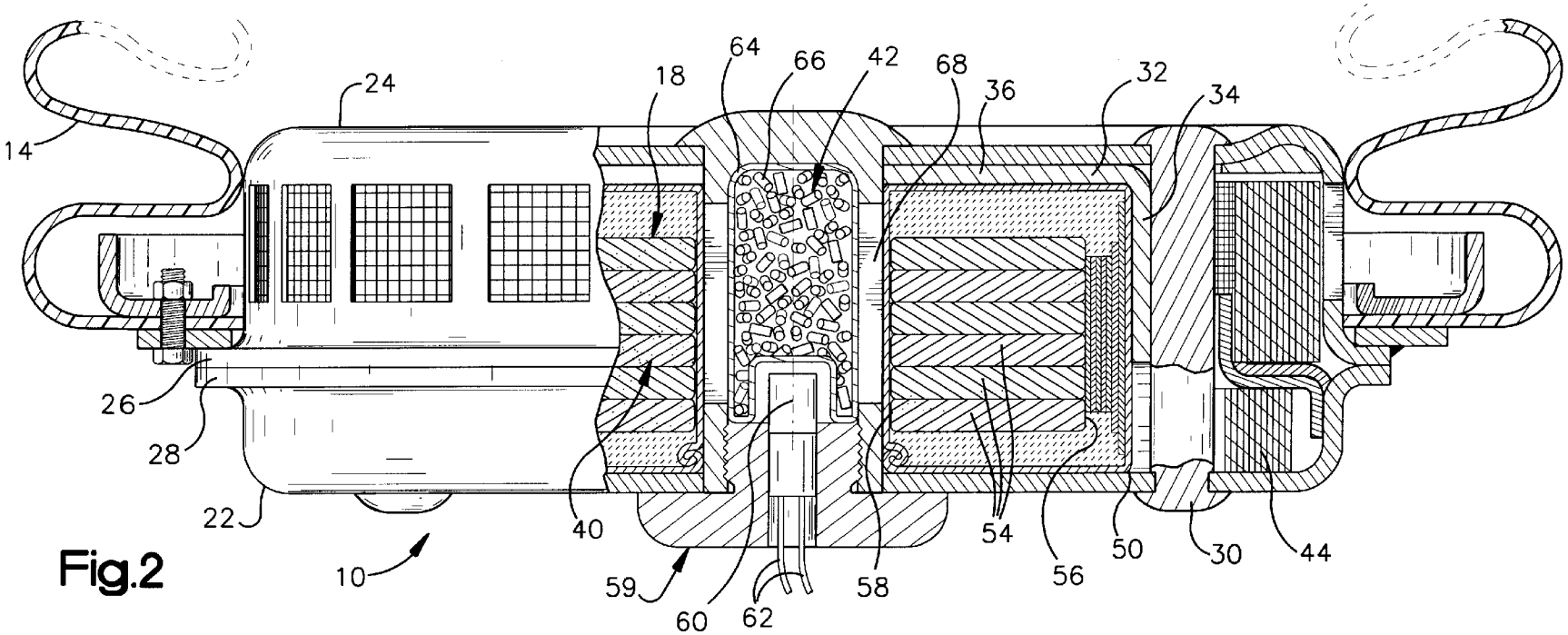
FIG. 2 is an enlarged, sectional view showing the inflator of FIG. 1.

The specific structure of the inflator 10 can vary. Referring to FIG. 2, the inflator 10 comprises a base section 22 and a diffuser section 24. The two sections 22 and 24 are joined together at mounting flanges, 28 and 26, which are attached to each other by a continuous weld. A plurality of rivets 30 also hold the diffuser section 24 and the base section 22 together.

A combustion cup 32 is seated between the diffuser section 24 and the base section 22. The combustion cup 32 comprises an outer cylindrical wall 34 and an annular top wall 36. The combustion cup 32 divides the inflator 10 into a combustion chamber 40, which is located within the combustion cup 32, and a filtration chamber 44, which is annular in shape and is located outside the combustion cup 32.

The combustion chamber 40 houses an inner container 50, which is hermetically sealed. The inner container 50 holds gas generating material 18, which is in the form of a plurality of gas generating disks 54. The gas generating disks 54 have a generally toroidal configuration with a cylindrical exterior surface 56 and an axially extending hole defined by a cylindrical interior surface 58. The disks 54 are positioned in the container in a stacked relationship with the axially extending holes in alignment. Each disk 54 has generally flat opposed surfaces and may have protuberances on such surfaces to space one disk slightly from another. This configuration of the disks 54 promotes a uniform combustion of the disks 54. The gas generating material could, alternatively, be provided in the form of pellets or tablets.

The cylindrical interior surfaces 58 of the disks 54 encircle an ignition chamber 42. The ignition chamber 42 is defined by a two-piece, tubular igniter housing 59 that fits within the combustion cup 32 and the disks 54 and contains a squib 60. The squib 60 contains a small charge of ignitable material (not shown). Electric leads 62 convey a current to the squib 60. The current is provided when the crash sensor 20, which is responsive to a condition indicative of a vehicle collision, closes an electrical circuit that includes a power source (not shown). The current generates heat in the squib 60 that ignites the ignitable material.

The ignition chamber 42 also has a canister 64 that contains an autoignition material 66. The autoignition material 66 is in the form a plurality of cylindrically shaped pellets. The autoignition material 66 generates, upon ignition, heat and combustion products. The heat and combustion products exit from the ignition chamber 42 through openings 68 in the igniter housing 59 that lead to the combustion chamber 40. The heat and combustion products of the autoignition material 66 penetrate the container 50 and ignite the gas generating material 18.

The autoignition material 66 is ignited by the small charge of ignitable material of the squib 60. The autoignition material 66 will also spontaneously ignite at a predetermined temperature. The predetermined temperature is below the temperature at which the inflator 10 begins to lose structural integrity and below the temperature at which the gas generating material 18 normally ignites.

In accordance with the present invention, either the gas generating material 18 or the autoignition material 66 or both the gas generating material 18 and autoignition material 66 comprises a plasticized cyclodextrin nitrate ester.

A cyclodextrin nitrate ester is prepared from cyclodextrin. Cyclodextrin has a cyclic structure, which consists of 1,4-α-glucosidically linked D-glucose units. Preferred cyclodextrins are α-cyclodextrin with 6 glucosidically linked D-glucose units, β-cyclodextrin with seven glucosidically linked D-glucose units, and γ-cyclodextrin with eight glucosidically linked D-glucose units, or mixtures of these compounds. Each D-glucose unit in a cyclodextrin has three free hydroxyl groups (—OH) capable of being nitrated to a nitrate ester group (—$ONO_2$). Preferably, an average of about 2 to about 3, more preferably an average of about 2 to about 2.5, nitrate ester groups per D-glucose unit are present in the nitrated product, cyclodextrin nitrate ester. These ranges for nitrate ester content apply to all cyclodextrin nitrate esters including α-cyclodextrin, β-cyclodextrin, and γ-cyclodextrin. A preferred cyclodextrin nitrate ester in the present invention is β-cyclodextrin with 2 nitrate ester groups per D-glucose unit.

The cyclodextrins can be nitrated using conventional techniques that are used in the preparation of nitrocellulose, such as treatment of cyclodextrin with nitric acid. The degree of nitration can be controlled by varying the nitration conditions, using well-known technology. Nitration of cyclodextrin can be accomplished by mixing the cyclodextrin with 70% to 90% concentrated nitric acid ($HNO_3$). Nitration of cyclodextrin can also be accomplished by mixing the cyclodextrin with 90% concentrated nitric acid ($HNO_3$) and sulfuric acid, or 90% concentrated nitric acid ($HNO_3$) and oleum.

The cyclodextrin nitrate ester is plasticized by mixing particles of the cyclodextrin nitrate ester with a liquid plasticizer. The liquid plasticizer of the present invention is an inert plasticizer (non-energetic), an energetic plasticizer, or a mixture of an inert and energetic plasticizer. Examples of inert plasticizers are dimethtyl phthalate, diethyl phthalate, dibutylphthalate, or triacetin. Examples of energetic plasticizer are nitrate ester plasticizers such as trimethylol ethane trinitrate (TMETN), butane triol trinitrate (BTTN), diethylene glycol dinitrate (DEGDN), or mixtures thereof; nitroplasticizers such as bis-dinitropropyl formal or bis-dinitropropyl acetal or mixtures thereof; nitroamino plasticizers such as N-ethyl nitratoethyl nitroamine, N-methyl nitratoethyl nitroamine, N-butyl-N-nitratoethyl nitroaminine, N,N'-dinitratoethyl nitroamine (DINA), or mixtures thereof; and azido plasticizers such as bis-azido-terminated GAP oligomers (GAP-A), 1,5-diazido-3-nitroaminopentane (DANPE), or mixtures thereof. Preferred plasticizers, are a 1:1 mol mixture of bis-dinitropropyl formal and bis-dinitropropyl acetal (BDNPF/A), and bis-azidol-terminated GAP oligomers (GAP-A).

The ratio of cyclodextrin nitrate ester to plasticizer is that amount effective to form collodial particles of cyclodextrin nitrate ester. The collodial particles are relatively tacky and can agglomerate into a loosely packed body, as distinguished from a solid composite. Preferably, the ratio of cyclodextrin nitrate ester to plasticizer is that ratio sufficient to form agglomerate particles of collodial plasticized cyclodextrin that have an autoignition temperature (i.e. lowest temperature at which spontaneous ignition occurs) between about 150° C. and about 180° C. A preferred ratio of cyclodextrin nitrate ester to plasticizer is from about 9:1 to about 1:1.5.

A critical characteristic of the plasticized cyclodextrin nitrate ester is that it is resistant to thermal decomposition at a temperature less than 150° C. The amount of plasticizer should be less than about 65% based on the weight of the cyclodextrin nitrate ester and plasticizer. If the plasticizer is energetic and present in an amount in excess of about 65%, thermal decomposition of the cyclodextrin nitrate ester can occur at a temperature below 150° C. If the plasticizer is inert and present in an amount in excess of about 65%, its dilution effect can increase the auto-ignition temperature so that the plasticized cyclodextrin nitrate ester will not autoignite in the desired range of 150° C. to 180° C.

The plasticized cyclodextrin nitrate ester can be used either as a component in the gas generating material or as an autoignition material. In a vehicle occupant protection apparatus, the gas generating material serves a function that differs from the function of the autoignition material. The difference in functions of the gas generating material and the autoignition material requires that the formulations for these two materials be different.

The gas generating material includes an oxidizer in addition to the plasticized cyclodextrin nitrate ester. The oxidizer in the gas generating material can be any oxidizer commonly used in a vehicle occupant protection apparatus, such as inorganic salt oxidizers. Examples of an inorganic salt oxidizer that can be used in the gas generating material of the present invention are alkali metal nitrates such as sodium nitrate and potassium nitrate, alkaline earth metal nitrates such as strontium nitrate and barium nitrate, alkali metal perchlorates such as sodium perchlorate, potassium perchlorate, and lithium perchlorate, alkaline earth metal perchlorates, ammonium perchlorate, ammonium nitrate, or a mixture thereof.

A preferred oxidizer is ammonium nitrate. Ammonium nitrate is preferred because it produces, upon combustion, a gas product essentially free of smoke and toxic gases.

When ammonium nitrate is used as the oxidizer, the ammonium nitrate is preferably phase stabilized. The phase stabilization of ammonium nitrate is well known. In one method, the ammonium nitrate is doped with a metal cation in an amount that is effective to minimize the volumetric and structural changes associated with phase transitions to pure ammonium nitrate. A preferred phase stabilizer is potassium nitrate. Other useful phase stabilizers include potassium salts such as potassium dichromate, potassium oxalate, and mixtures of potassium dichromate and potassium oxalate. Ammonium nitrate can also be stabilized by doping with copper and zinc ions. Other compounds, modifiers, and methods that are effective to phase stabilize ammonium nitrate are well known and suitable in the present invention.

Ammonium perchlorate, although a good oxidizer, is preferably combined with a non-halogen alkali metal or alkaline earth metal salt. Preferred mixtures of ammonium perchlorate and a non-halogen alkali metal or alkaline earth metal salt are ammonium perchlorate and sodium nitrate, ammonium perchlorate and potassium nitrate, and ammonium perchlorate and lithium carbonate. Ammonium perchlorate produces, upon combustion, hydrogen chloride. Non-halogen alkali metal or alkaline earth metal salts react with hydrogen chloride produced upon combustion to form alkali metal or alkaline earth metal chloride. Preferably, the non-halogen alkali metal or alkaline earth metal salt is present in an amount sufficient to produce a combustion product that is substantially free (i.e. less than 2% by weight of the combustion product) of hydrogen chloride.

Preferably, the oxidizer is ground into two fractions, one being a coarse fraction, for instance, having an average particle size of about 100 to about 600 microns, the other being a fine fraction, for instance, having an average particle size of about 10 to about 60 micron. The amount of the course fraction in the gas generating material is preferably in the range of about 50% to about 75% by weight, based on the weight of the oxidizer. The amount of the fine fraction in the gas generating material is preferably about 25% to about 50% by weight, based on the weight of the oxidizer.

The amount of oxidizer in the gas generating material is that amount necessary to achieve sustained combustion of the gas generating material. The amount of oxidizer necessary to achieve sustained combustion of the gas generating material is from about 30% to about 80% by weight of the gas generating material. A preferred amount of oxidizer is that amount necessary to oxygen balance the gas generating material and produce, on combustion with the plasticized cyclodextrin nitrate ester, a combustion product that is substantially free of carbon monoxide. By substantially free of carbon monoxide, it is meant that the volume of carbon monoxide is less than about 4% by volume of gas produced upon combustion. A preferred amount of oxidizer is from about 60% to about 80% by weight of the gas generating material.

The gas generating material in the present invention can comprise other ingredients in addition to the plasticized cyclodextrin nitrate ester and the oxidizer. For instance, the gas generating material can comprise a supplemental fuel. Preferred supplemental fuels are organic fuels that are not azides. Examples of organic fuels that are not azides are organic nitrates or nitroorganics such as nitroguanidine (NQ), guanidine nitrate (GN), triamino guanidine nitrate (TAGN), tetramethyl ammonium nitrate, cyclotrimethylenetrinitramine (RDX), cyclotetramethylenetetranitramine (HMX), and nitrocellulose, azoles including triazoles and tetrazoles such as 5-aminotetrazole (5-AT) and 3-nitro-1,2,4-triazole-5-one (NTO), oxamide, and urea and urea salts. The amount of supplemental fuel can be in the range of 0 to about 30% by weight based on the weight of the gas generating material.

The gas generating material can also include a binder. Preferably, the binder is non-energetic. Suitable binders for gas generating materials are well known in the art. Preferred binders include cellulose acetate butyrate, polycarbonate, polyurethanes, polyesters, polyethers, polysuccinates, thermoplastic rubbers, polybutadienes, polystyrene, and mixtures thereof. A preferred binder is KRATON (trademark), a polyethylene/butylene-polystyrene block copolymer manufactured by Shell Company. A preferred amount of binder is from about 0 to about 10% by weight of the gas generating material. More preferably, the amount of binder is from about 2.5% to about 5% by weight of the gas generating material.

The gas generating material may also include 0 to about 10% by weight of other ingredients commonly added to a gas generating material for actuating a vehicle occupant protection apparatus, such as process aids, coolants, burn rate modifiers, and ignition aids.

The gas generating material can be prepared by mixing particles of the plasticized cyclodextrin nitrate ester with particles of the oxidizer and other ingredients, if used, in a conventional mixing device. The mixture is compacted into the configuration of the disks described above, as illustrated in FIG. 2, or into some other desired configuration.

Optionally, the particles of plasticized cyclodextrin nitrate ester and the particles of oxidizer (and other ingredients, if used) may be mixed with a liquid to form a liquid slurry. The liquid slurry is dried, and the dried mixture is compacted into the configuration of the disks described above, as illustrated in FIG. 2, or into some other desired configuration.

The autoignition material, in contrast to the gas generating material, predominantly comprises plasticized cyclodextrin nitrate ester. The autoignition material must spontaneously ignite at a temperature between about 150° C. and about 180° C. The autoignition material may comprise other ingredients, in addition to the plasticized cyclodextrin nitrate ester, such as oxidizers, burn rate modifiers, supplemental fuels, processing aids, and binders. The combined weight of these other ingredients is between 0 and about 30% by weight of the autoignition material. The addition of oxidizers, burn rate modifiers, supplemental fuels, processing aids, and binders in substantial amounts in excess of 30%, by weight of the autoignition material, can potentially increase the autoignition temperature to a temperature greater than about 180° C. or decrease the autoignition temperature to a temperature less than about 150° C. As such, in a preferred embodiment, the autoignition material consists essentially of the plasticized cyclodextrin nitrate ester.

The autoignition material can be prepared by compacting the particles of plasticized cyclodextrin nitrate ester into the configuration of the cylindrical pellet of FIG. 2 or into some other configuration. If the autoignition material comprises other ingredients in addition to the plasticized cyclodextrin nitrate, the autoignition material is prepared by mixing particles of the plasticized cyclodextrin nitrate ester and particles of the other ingredients in a conventional mixing device. The mixture is then compacted into the configuration of the cylindrical pellet of FIG. 2 or into some other configuration.

Optionally, the particles of plasticized cyclodextrin nitrate ester (and other ingredients if used) may be mixed with a liquid to form a liquid slurry. The liquid slurry is dried, and the dried mixture is compacted into the configuration of the cylindrical pellet of FIG. 2 or into some other desired configuration.

EXAMPLES

Examples 1–6 illustrate the use of plasticized cyclodextrin nitrate ester, prepared from β-cyclodextrin with 2 nitrate groups per D-glucose unit (β-CDN-14) and bis-azido-terminated GAP oligomers (GAP-A), and an oxidizer in the gas generating material of the present invention. In Examples 1–6, the oxidizers are respectively ammonium nitrate phase stabilized with potassium nitrate (Examples 1–3) and a 1:1 molar ratio of sodium nitrate to ammonium perchlorate (Examples 4–6).

The compositions and combustion results for Examples 1–6 are given in Table 1. The combustion results for Examples 1–6 are calculated using the U.S. Navy PEP Thermochemical Equilibrium Code.

TABLE 1

| | EX 1 | EX 2 | EX 3 | EX 4 | EX 5 | EX 6 |
|---|---|---|---|---|---|---|
| Compositions | | | | | | |
| β-CDN-14 wt % | 28.25 | 21.31 | 7.44 | 41.33 | 35.59 | 24.11 |
| GAP-A wt % | 3.00 | 6.00 | 12.00 | 3.00 | 6.00 | 12.00 |
| AN wt % | 58.44 | 61.78 | 68.48 | | | |
| KN wt % | 10.31 | 10.90 | 12.08 | | | |
| 1:1 mol NaN:AP wt % | | | | 55.67 | 58.41 | 63.89 |
| Chamber Results at 2000 psi | | | | | | |
| Flame T, K | 3061 | 2924 | 2589 | 3212 | 3445 | 3299 |
| Impetus, lbf-s/lbm | 396,386 | 378,972 | 338,952 | 374,443 | 398,118 | 375,219 |
| MW | 25.82 | 25.79 | 25.57 | 28.85 | 29.07 | 29.48 |
| Exhaust Results at 2,000 psi | | | | | | |
| Temp, K | 1653 | 1511 | 1306 | 2304 | 2226 | 2039 |
| Impetus, lbf-s/lbm | 208,711 | 193,820 | 170,237 | 244,446 | 236,020 | 202,343 |
| MW | 26.76 | 26.48 | 26.09 | 31.40 | 31.45 | 31.44 |
| L of Exhaust gases per 100 g composition | | | | | | |
| $H_2O$ | 42.74 | 44.26 | 47.32 | 28.72 | 28.98 | 29.5 |
| $N_2$ | 21.03 | 22.44 | 25.24 | 10.85 | 11.67 | 13.29 |
| $CO_2$ | 14.82 | 13.02 | 9.43 | 24.08 | 23.06 | 21 |
| Condensed Products, g per 100 g composition | | | | | | |
| $KHCO_3$ | 10.21 | 10.8 | 11.97 | | | |
| NaCl | | | | 16.07 | 16.858 | 18.44 |

Example 1 contains by weight of the gas generating material 28.25% β-cyclodextrin nitrate ester, 3.00% GAP-A, 58.44% ammonium nitrate, and 10.31% potassium nitrate, for substantially complete combustion of the carbon atoms in the plasticized cyclodextrin nitrate ester to carbon dioxide. The flame temperature, exhaust temperature, and amount of residue produced meet criteria for a gas generating material for inflating a vehicle occupant device. The amount of gas produced upon combustion and its energy (impetus) are effective for actuating a vehicle occupant protection device such as an air bag.

Example 2 contains by weight of the gas generating material 21.31% β-cyclodextrin nitrate ester, 6.00% GAP-A, 61.78% ammonium nitrate, and 10.90% potassium nitrate, for substantially complete combustion of the carbon atoms in the plasticized cyclodextrin nitrate ester to carbon dioxide. The flame temperature, exhaust temperature, and amount of residue produced meet criteria for a gas generating material for inflating a vehicle occupant device. The amount of gas produced upon combustion and its energy (impetus) are effective for actuating a vehicle occupant protection device such as an air bag.

Example 3 contains by weight of the gas generating material 7.44% β-cyclodextrin nitrate ester, 12.00% GAP-A, 68.48% ammonium nitrate, and 12.08% potassium nitrate, for substantially complete combustion of the carbon atoms in the plasticized cyclodextrin nitrate ester to carbon dioxide. The flame temperature, exhaust temperature, and amount of residue produced meet criteria for a gas generating material for inflating a vehicle occupant device. The amount of gas produced upon combustion and its energy (impetus) are effective for actuating a vehicle occupant protection device such as an air bag.

Example 4 contains by weight of the gas generating material 41.33% β-cyclodextrin nitrate ester, 3.00% GAP-A, and 55.67% 1:1 by moles sodium nitrate and ammonium perchlorate, for substantially complete combustion of the carbon atoms in the plasticized cyclodextrin nitrate ester to carbon dioxide. The flame temperature, exhaust temperature, and amount of residue produced meet criteria for a gas generating material for inflating a vehicle occupant device. The amount of gas produced upon combustion and its energy (impetus) are effective for actuating a vehicle occupant protection device such as an air bag.

Example 5 contains by weight of the gas generating material 35.59% β-cyclodextrin nitrate ester, 6.00% GAP-A, and 58.41% 1:1 by moles sodium nitrate and ammonium perchlorate, for substantially complete combustion of the carbon atoms in the plasticized cyclodextrin nitrate ester to carbon dioxide. The flame temperature, exhaust temperature, and amount of residue produced meet criteria for a gas generating material for inflating a vehicle occupant device. The amount of gas produced upon combustion and its energy (impetus) are effective for actuating a vehicle occupant protection device such as an air bag.

Example 6 contains by weight of the gas generating material 24.11% β-cyclodextrin nitrate ester, 12.00% GAP- A, and 63.89% 1:1 by moles sodium nitrate and ammonium perchlorate, for substantially complete combustion of the carbon atoms in the plasticized cyclodextrin nitrate ester to carbon dioxide. The flame temperature, exhaust temperature, and amount of residue produced meet criteria for a gas generating material for inflating a vehicle occupant device. The amount of gas produced upon combustion and its energy (impetus) are effective for actuating a vehicle occupant protection device such as an air bag.

From the above description of the invention, those skilled in the art will perceive improvements, changes and modifications in the invention. Such improvements, changes and modifications within the skill of the art are intended to be covered by the appended claims.

Having described the invention, the following is claimed:

1. An apparatus comprising;

a vehicle occupant protection device; and an actuator for actuating said vehicle occupant protection device, said actuator including a gas generating material or both a gas generating material and an autoignition material, said gas generating material, said autoignition material, or both said gas generating material and said autoignition material comprising a plasticized cyclodextrin nitrate ester that has an autoignition temperature in the range of about 150° C. to about 180° C. and is resistant to thermal decomposition at a temperature less than 150° C.

2. The apparatus of claim 1, wherein the cyclodextrin nitrate ester is selected from the group consisting of α-cyclodextrin nitrate ester, β-cyclodextrin nitrate, and γ-cyclodextrin nitrate.

3. The apparatus of claim 2, wherein the cyclodextrin nitrate ester has an average of about 2 to about 2.5 nitrate ester groups per D-glucose unit.

4. The apparatus of claim 3 wherein the cyclodextrin nitrate ester is β-cyclodextrin with 2 nitrate ester groups per D-glucose unit.

5. The apparatus of claim 1 wherein the plasticizer is selected from the group consisting of dimethtyl phthalate, diethyl phthalate, dibutylphthalate, triacetin, trimethylol ethane trinitrate (TMETN), butane triol trinitrate (BTTN), diethylene glycol dinitrate (DEGDN), bis-dinitropropyl formal, bis-dinitropropyl acetal, N-ethyl nitratoethyl nitroamine, N-methyl nitratoethyl nitroamine, N-butyl-N-nitratoethyl nitroaminine, N,N'-dinitratoethyl nitroamine (DINA), bis-azido-terminated GAP oligomers (GAP-A), 1,5-diazido-3-nitroaminopentane (DANPE), and mixtures thereof.

6. The apparatus of claim 5, wherein the plasticizer is selected from the group consisting of a 1:1 mol mixture of bis-dinitropropyl formal and bis-dinitropropyl acetal (BDNPF/A) and bis-azidol-terminated GAP oligomers (GAP-A).

7. The apparatus of claim 1, wherein the ratio of cyclodextrin nitrate ester to plasticizer is that amount to form collodial particles of plasticized cyclodextrin nitrate ester.

8. The apparatus of claim 1, wherein the ratio of cyclodextrin nitrate ester to plasticizer is from about 9:1 to about 1:1.5.

9. The apparatus of claim 1, wherein the gas generating material comprises the plasticized cyclodextrin nitrate ester.

10. The apparatus of claim 9, wherein the gas generating material further comprises an oxidizer.

11. The apparatus of claim 10, wherein the oxidizer is selected from the group consisting alkali metal nitrates, alkaline earth metal nitrate, alkali metal perchlorates, alkaline earth metal perchlorates, ammonium perchlorate, ammonium nitrate, and mixtures thereof.

12. The apparatus of claim 10, wherein the amount of oxidizer is from about 30% to about 80% by weight, based on the weight of the gas generating material.

13. The apparatus of claim 10, wherein the oxidizer is ammonium nitrate in an amount of about 60% to about 80% by weight of the gas generating material.

14. The apparatus of claim 1, wherein autoignition material comprises the plasticized cyclodextrin nitrate ester.

15. The apparatus of claim 14 wherein the autoignition material has an autoignition temperature in the range of about 150° C. to about 180° C.

16. The apparatus of claim 1, wherein the autoignition material consists essentially of the plasticized cyclodextrin nitrate ester.

17. An apparatus comprising;

a vehicle occupant protection device; and an inflator for inflating said vehicle occupant protection device, said inflator including a gas generating material for producing gas for inflating said vehicle occupant protection device, said gas generating material comprising a plasticized cyclodextrin nitrate ester that has an autoignition temperature in the range of about 150° C. to about 180° C. and is resistant to thermal decomposition at a temperature less than 150° C. and an oxidizer.

18. The apparatus of claim 17, wherein the cyclodextrin nitrate ester is selected from the group consisting of α-cyclodextrin nitrate ester, β-cyclodextrin nitrate, and γ-cyclodextrin nitrate.

19. The apparatus of claim 18, wherein the cyclodextrin nitrate ester has an average of about 2 to about 2.5 nitrate ester groups per D-glucose unit.

20. The apparatus of claim 17 wherein the plasticizer is selected from the group consisting of dimethtyl phthalate, diethyl phthalate, dibutylphthalate, triacetin, trimethylol ethane trinitrate (TMETN), butane triol trinitrate (BTTN), diethylene glycol dinitrate (DEGDN), bis-dinitropropyl formal, bis-dinitropropyl acetal, N-ethyl nitratoethyl nitroamine, N-methyl nitratoethyl nitroamine, N-butyl-N-nitratoethyl nitroaminine, N,N'-dinitratoethyl nitroamine (DINA), bis-azido-terminated GAP oligomers (GAP-A), 1,5-diazido-3-nitroaminopentane (DANPE), and mixtures thereof.

21. The apparatus of claim 20, wherein the plasticizer is selected from the group consisting of a 1:1 mol mixture of bis-dinitropropyl formal and bis-dinitropropyl acetal (BDNPF/A) and bis-azidol-terminated GAP oligomers (GAP-A).

22. The apparatus of claim 17, wherein the ratio of cyclodextrin nitrate ester to plasticizer is that amount to form collodial particles of plasticized cyclodextrin nitrate ester.

23. The apparatus of claim 22, wherein the ratio of cyclodextrin nitrate ester to plasticizer is from about 9:1 to about 1:1.5.

24. The apparatus of claim 17, wherein the oxidizer is selected from the group consisting alkali metal nitrates, alkaline earth metal nitrate, alkali metal perchlorates, alkaline earth metal perchlorates, ammonium perchlorate, ammonium nitrate, and mixtures thereof.

25. The apparatus of claim 24, wherein the amount of oxidizer is from about 30% to about 80% by weight, based on the weight of the gas generating material.

26. The apparatus of claim 17, wherein the oxidizer is ammonium nitrate in an amount of about 60% to about 80% by weight of the gas generating material.

27. An apparatus comprising;

an inflatable vehicle occupant protection device;

an inflator housing;

a gas generating material within said inflator housing, said gas generating material, when ignited, generating gas for inflating the vehicle occupant protection device; and an autoignition material for igniting said gas generating material, said autoignition material comprising a plasticized cyclodextrin nitrate ester that has an autoignition temperature in the range of about 150° C. to about 180° C. and is resistant to thermal decomposition at a temperature less than 150° C.

28. The apparatus of claim 27, wherein the autoignition material has autoignition temperature in the range of about 150° to about 180° C.

29. The apparatus of claim 27, wherein the cyclodextrin nitrate ester is selected from the group consisting of α-cyclodextrin nitrate ester, β-cyclodextrin nitrate, and γ-cyclodextrin nitrate.

30. The apparatus of claim 27, wherein the cyclodextrin nitrate ester has an average of about 2 to about 2.5 nitrate ester groups per D-glucose unit.

31. The apparatus of claim 30, wherein the plasticizer is selected from the group consisting of a 1:1 mol mixture of bis-dinitropropyl formal and bis-dinitropropyl acetal (BDNPF/A) and bis-azidol-terminated GAP oligomers (GAP-A).

32. The apparatus of claim 27, wherein the ratio of cyclodextrin nitrate ester to plasticizer is that amount to form collodial particles of plasticized cyclodextrin nitrate ester.

33. The apparatus of claim 32, wherein the ratio of cyclodextrin nitrate ester to plasticizer is from about 9:1 to about 1:1.5.

34. The apparatus of claim 28, wherein the autoignition material consists essentially of a plasticized cyclodextrin nitrate ester.

35. An apparatus comprising:

an inflatable vehicle occupant protection device;

an inflator housing;

a gas generating material within said inflator housing, said gas generating material, when ignited, generating gas for inflating the vehicle occupant protection device; and an autoignition material for igniting said gas generating material, said autoignition material comprising a plasticized cyclodextrin nitrate ester that has an autoignition temperature in the range of about 150° C. to about 180° C. and is resistant to thermal decomposition at a temperature less than 150° C., wherein the ratio of cyclodextrin nitrate ester to plasticizer is from about 9:1 to about 1:1.5.

36. The apparatus of claim 35 wherein the plasticizer is selected from the group consisting of a 1:1 mol mixture of bis-dinitropropyl formal and bis-dinitropropyl acetal (BDNPF/A) and bis-azidol-terminated GAP oligomers (GAP-A).

37. The apparatus of claim 36 wherein the plasticizer comprises a 1:1 mol mixture of bis-dinitropropyl formal and bis-dinitropropyl acetal (BDNPF/A).

* * * * *